United States Patent [19]

Banker et al.

[11] 4,028,096

[45] June 7, 1977

[54] METHOD OF MELTING METALS TO REDUCE CONTAMINATION FROM CRUCIBLES

[75] Inventors: John G. Banker, Kingston; Hubert L. Wigginton, Oak Ridge, both of Tenn.

[73] Assignee: The United States of America as represented by the United States Energy Research and Development Administration, Washington, D.C.

[22] Filed: May 13, 1976

[21] Appl. No.: 686,447

[52] U.S. Cl. ..... 75/20 R; 75/10 R; 75/84; 266/44

[51] Int. Cl.[2] ..... C22B 60/02

[58] Field of Search ..... 75/10, 96, 20, 84, 84.1; 266/282, 285

[56] References Cited

UNITED STATES PATENTS

| | | | |
|---|---|---|---|
| 2,870,006 | 1/1959 | Morning | 75/84 |
| 3,660,075 | 5/1972 | Harbur | 75/10 R |
| 3,773,499 | 11/1973 | Melnikov | 75/65 ZM |
| 3,820,978 | 6/1974 | Magoteaux | 75/10 R |
| 3,917,479 | 11/1975 | Sayce | 75/10 R |

*Primary Examiner*—Peter D. Rosenberg
*Attorney, Agent, or Firm*—Dean E. Carlson; David S. Zachry; Allen Uzzell

[57] ABSTRACT

Contamination of metals from crucible materials during melting operations is reduced by coating the interior surface of the crucible with a ceramic non-reactive with the metallic charge and disposing a metal liner formed from a portion of the metallic charge within the coated crucible. The liner protects the ceramic coating during loading of the remainder of the charge and expands against the ceramic coating during heat-up to aid in sintering the coating.

5 Claims, 1 Drawing Figure

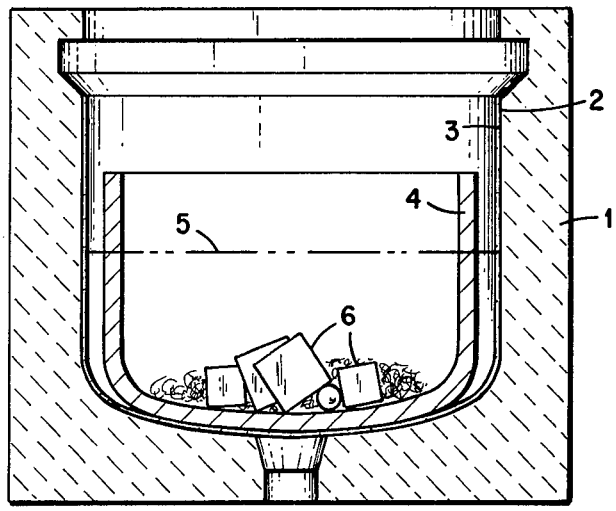
2
3
4
1
5
6

METHOD OF MELTING METALS TO REDUCE CONTAMINATION FROM CRUCIBLES

BACKGROUND OF THE INVENTION

This invention was made in the course of, or under, a contract with the Energy Research and Development Administration. It relates in general to the melting of metals for casting and alloying operations and more particularly to the prevention of contamination of molten metals by crucible materials.

In a variety of metallurgical processes, metals are heated to temperatures at which they are reactive with crucible materials such as graphite, resulting in contamination of the finished product. Typcially, such crucibles are provided with ceramic coatings whcih are substantially inert to the molten metals. Typical of such coatings is BN to protect molten aluminum from carbon contamination from graphite crucibles, as described in U.S. Pat. No. 3,245,674, to Baer, et al.

A particularly troublesome contamination problem is carbon contamination in uranium and uranium alloys such as uranium-16.6 atom percent niobium-5.6 atom percent zirconium. When uranium is melted in graphite crucibles with reactive metals such as niobium, titanium, vanadium, tantalum, molybdenum, zirconium, etc., the metals react with carbon and carbon oxides forming carbides which float to the surface of the melt causing the alloy to be deficient in these components, deleteriously affecting the mechanical properties and corrosion resistance of the alloy. While a known carbon content results in a predictable alloy composition, carbon pick-up from graphite crucibles used in induction melting produces unpredictable compositional variations. Accordingly, variation in alloy compositions in uranium alloys is directly correlatable to carbon contamination from graphite crucibles.

PRIOR ART

Several approaches to the problem of contamination of molten materials by crucible materials, are found in the prior at. One approach for producing high purity materials is the skull melting tehcnique such as described in U.S. Pat. No. 3,051,555 to Rummell (Aug. 28, 1962). In this method, molten material is contained within a solid skull of like material maintained on the inner surface of a water-cooled copper crucible. While capable of producing alloys of ultra-high purity, the skull melting is relatively expensive and requires constant attention to maintain the skull.

Another approach is to use refractory ceramic crucibles or crucible inserts such as $CaF_2$, MgO, CaO, and $Al_2TiO_5$ described in commonly assigned U.S. Pat. Nos. 3,328,017 to Connor (June 27, 1962) and 3,890,140 to Asbury (June 17, 1975). These refractory crucibles are generally considered too expensive for plant scale alloying operations.

Still another approach is to use refractory oxide coatings on crucibles, e.g. graphite, such as plasma-sprayed yttria (U.S. Pat. No. 3,734,480 to Zanis, May 22, 1973) and sprayed yttria particles in $K_2SiO_3$ solution (U.S. Pat. No. 3,660,077 to Harbur et al., May 2, 1972). Another coating method for crucibles is described in commonly assigned U.S. application Ser. No. 617,126 of Holcombe et al. for "Adhesive Plasters" filed Sept. 26, 1975. The chief difficulties with the use of ceramic coatings are the expense of plasma spraying and lack of adhesion between the coating material and the crucible material, especially graphite at high temperatures.

Furthermore, many ceramic coatings are applied as slurries or suspensions of ceramic powders and sinter in place during heat-up. Such coatings, being in an unsintered state, are fragile and prone to damage during loading of sharp heavy chunks of the metal charge.

SUMMARY OF THE INVENTION

It is an object of this invention to provide a method of preventing contamination from ceramic coated crucibles which is inexpensive and suitable for scale melting operations.

It is a further object to provide a method for reducing contamination of molten metals by crucibles coated by the method of applying a suspension comprising particles of refractory material to the interior surface of the crucible.

It is a further object to provide a method which is effective for preventing carbon contamination of uranium and uranium alloys during melting in graphite crucibles.

These and other objects are accomplished according to our invention in a method of reducing the contamination of a metallic charge from a crucible during melting operations comprising first providing the interior surface of said crucible with a ceramic coating substantially non-reactive with said metallic charge and disposing a liner within the coated crucible, said liner formed from at least a portion of said metallic charge, said liner being substantially concentric to the inner surface of said crucible and slightly undersized such that as the crucible is heated, the liner expands against the ceramic coating prior to the melting of said liner. The ceramic coating may be any refractory composition which is non-reactive with the metallic charge and the crucible material and which is capable of withstanding the process conditions without breaking down or spalling off. The ceramic coating may be provided as a dense coating, e.g., plasma sprayed, or as unfired refractory powder which sinters in place during heat-up. Our method is especially useful for preventing carbon contamination from graphite crucibles, particularly during the melting and alloying of uranium.

Our method is especially effective when the ceramic coating is a ceramic paint, provided by applying a suspension of refractory particles to the surface of the crucible. During loading the liner protects the coating from damage and during heat-up, the liner expands against the coated crucible surface prior to melting causing a hot-pressing effect to enhance the quality and strength of the coating.

BRIEF DESCRIPTION OF THE DRAWING

The single FIGURE is a cross-sectional view of a crucible provided with a ceramic coating and a liner according to this invention.

DETAILED DESCRIPTION

According to our invention, contamination of metallic charges by crucible materials is reduced by first providing the interior surface of the crucible with a ceramic coating such as a plasma-sprayed or brush-applied oxide coating, and then disposing concentric liner within the crucible. The liner is formed of at least a portion of the metallic charge material and is slightly undersized so that it expands and presses against the ceramic coating during heat-up prior to melting to aid in densification of the coating. The liner of this invention is substantially distinct from crucible liners used in the prior art such as U.S. Pat. Nos. 3,620,552; 3,890,149; 3,328,017; 3,689,051 and 3,470,017. These crucible liners function to contain the molten metal and facilitate removal of the melted charge. Our invention involves using a liner which is itself a portion of the metallic charge and is ultimately melted during the melting operation, becoming incorporated in the product.

According to our invention, the thickness of the liners is not critical and the entire charge can be formed into the liner if desired; however, this would likely be uneconomical. What is necessary is that the liner be substantially concentric to the inner surface of the crucible and be slightly undersized in diameter such that it expands against the coated surface during heat-up. Aside from strengthening the coating during heat-up, the liner functions to protect the coating during loading from the impact of sharp pieces of metal charge.

The metallic liner may be fabricated by conventional metal forming techniques such as rolling and pressing etc. It will be apparent to those skilled in the art our method requires that the liner be formed of material having a higher coefficient of thermal expansion than the crucible, and that our method is applicable to any crucible melting technique wherein at least a portion of the metallic charge can be formed into such a liner.

The liner of our invention is particularly useful when the crucible is coated with a ceramic paint. A ceramic paint for purposes of this invention is a fluid suspension comprising refractory particles which is applied with a brush or sprayer much like ordinary paint. Ceramic paints are well known in the art and include aqueous suspensions of yttria, zirconia, thoria, zirconium silicate, magnesia, magnesium zirconate, etc. Such ceramic paints are described in Uranium Metallurgy, Walter D. Wilkenson, Interscience Publishers, New York (1962) p. 263. For a particular application, a ceramic paint which is stable and non-reactive with the molten metals and the crucible material at process temperatures is used. During heat-up, the refractory particles sinter to provide dense, tough ceramic coatings.

The figure is an illustration of a loaded crucible suitable for practicing the method of out invention. A bottom-pour induction melting crucible 1 is provided on its interior surface 2 with a brush-applied ceramic coating 3. A metal liner 4 is fabricated from a portion of the charge to be melted. The liner is substantially concentric to the interior surface and of slightly smaller diameter. The liner extends to a height above the ultimate melt level 5 and functions to protect the coating from damage by sharp pieces 6 which make up the remainder of the metallic charge. The thickness of the coating 3 is magnified for clarity. According to our process, the crucible may be of any shape or size and the liner is concentric to the crucible. For purposes of this disclosure, ther term concentric is defined to mean having similar shape, and is not limited to circular or cylindrical shapes.

To demonstrate the effectiveness of out invention for reducing carbon contamination in uranium and uranium alloys melted in graphite crucibles, the following experimental examples are presented. The ceramic coating used in the examples was "yttria paint", a suspension of yttria particles in an aqueous 3% sodium carboxymethylcellulose solution. The coating may be provided by brush or spray coating the interior surface of the crucible with a suspension comprising $Y_2O_3$ in an aqueous suspending solution containing an effective suspending amount of sodium carboxymethylcellulose. This yttria composition is more fully described in commonly assigned copending U.S. application Ser. No. 629,245 of John G. Banker and Cressie E. Holcombe, Jr. for "Coating Method for Graphite" filed Nov. 6, 1975, which is incorporated herein by reference.

EXAMPLE I

A graphite crucible was coated with brush-applied yttria paint with a single coat of about 0.15 mm thickness. A 3 mm-thick liner of depleted uranium was placed within the crucible and the remainder of the charge was loaded into the liner. The total weight of the charge was 1600 kg. The crucible was placed into an induction furnace which was evacuated to less than 10 micrometers of mercury for the melting operation. The furnace temperature was increased 300° C per hour to 1275° C and held for 20 minutes to melt the charge. Then the graphite plug was knocked from the bottom of the crucible which allowed the molten uranium to fall into a mold for solidification. The formed billet was about 70 centimeters in height, 60 centimeters in width, and 20 centimeters in thickness. Carbon analysis of the billet indicated a total carbon content of 34 ppm. The uranium had a carbon content of 20 ppm prior to the melting operation. In a similar heat melted under similar conditions in a yttria paint coated crucible without a liner, the increase in carbon content was 30 ppm.

EXAMPLE II

This example demonstrates the improved uniformity of alloy composition attainable with our method. In twenty-seven separate heats uranium metal was combined with U-6 wt % Nb alloy to provide a metallic charge of 98 wt % uranium and 2 wt % niobium. The crucible was coated on the interior with brush-applied yttria paint as in Example I. The average total carbon content of the charges prior to melting was 55 ppm. In 13 of the heats, the crucible was provided with a 3 mm-thick liner of uranium metal formed from a portion of the charge. The other heats employed no liner. In each heat, the induction furnace was evacuated to less than 100 micrometes mercury. The temperature was increased 300° C per hour to 1400° C and held for 30 minutes to melt the charge. A graphite plug was knocked from the crucible which allowed the molten metal to fall into a mold and solidify into an ingot. Analyses of the ingots prepared using the liner according to this invention indicated that they averaged 75 ppm carbon and contained 1.989 wt % niobium with a standard deviation of 0.045. Analyses of the 14 ingots prepared without the liner indicated that they contained 95 ppm carbon and 1.899 wt % niobium with a 0.083 standard deviation.

As shown, when a portion of the charge is formed into a liner according to this invention the carbon pick-up is substantially reduced and the alloy composition among separate castings is more uniform. Furthermore, more of the reactive metal (niobium) is retained in the alloy.

Our method provides a simple, inexpensive method of reducing contamination of metals from crucible materials during melting operations. The use of a concentric liner according to our invention aids in protecting all ceramic-coated crucibles from coating damage including fully dense plasma-sprayed coatings. Our method is particularly advantageous when crucibles are coated with suspensions of refractory particles such as ceramic paints which densify during heat-up. The relative sizes of the crucible and liner are dependent upon their relative coefficients of thermal expansion. The liner must be large enough so that it expands sufficiently during heat-up prior to melting to engage the surface of the coated crucible. Of course, the closeness of the fit prior to heating can vary within limits and should depend upon the ease of loading the liner without scarring the ceramic coating. For example, a 29 in. inside diameter crucible of crucible grade graphite having a CTE of about $2 \times 10^{-6}$ deg. C.$^{-1}$ would require a uranium (CTE of about $13 \times 10^{-6}$ deg. C.$^{-1}$) liner of about ⅛ in. thickness and about 28 ½ in. outside diameter. With the benefit of this disclosure, it is a matter of routine experimentation for those skilled in the art to determine the proper dimensions for liners of various metals to provide the maximum reduction in contamination of the metallic charge.

What is claimed is:

1. A method of reducing the contamination of a metallic charge from a crucible during melting operations comprising:

a. first providing the interior surface of said crucible with a ceramic coating substantially non-reactive with said metallic charge;

b. disposing within said coated crucible a liner formed from at least a portion of said metallic charge, said liner being substantially concentric to the inner surface of said crucible and having an outside diameter less than the inside diameter of said coated crucible such that as the crucible is heated the liner expands and presses against said ceramic coating prior to melting; and c. heating said crucible to a temperature sufficient to completely melt said liner whereby said ceramic coating is contact with molten metallic charge.

2. The method of claim 1 wherein said crucible comprises graphite.

3. The method of claim 1 wherein said metallic charge comprises uranium.

4. The method of claim 1 wherein said ceramic coating is provided by applying a suspension comprising particles of refractory material to the interior surface of said crucible.

5. The method of claim 1 wherein said crucible is graphite, said metallic charge comprises uranium, said liner consists essentially of uranium, and said coating is provided by coating the interior surface of said crucible with a suspension comprising $Y_2O_3$ in an aqueous suspending solution containing an effective suspending amount of sodium carboxymethylcellulose.

* * * * *

UNITED STATES PATENT OFFICE

CERTIFICATE OF CORRECTION

Patent No. 4,028,096 Dated June 7, 1977

Inventor(s) John G. Banker and Hubert L. Wigginton

It is certified that error appears in the above-identified patent and that said Letters Patent are hereby corrected as shown below:

Column 1, line 16, "whcih" should read --which--
Column 1, line 43, "at" should read --art--
Column 1, line 44, "tehcnique" should read --technique--
Column 2, line 12, "for scale" should read --for plant scale--
Column 2, line 64, "disposing concentric" should read --disposing a concentric--
Column 3, line4, "3,890,149" should read --3,890,140--
Column 3, line 24, "art our" should read --art that our--
Column 3, line 47, "out" should read --our--
Column 3, line 60, "ther" should read --the--
Column 3, line 63, "out" should read --our--
Column 6, line 14, "is contact" should read --is in contact--

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*